US007074021B2

(12) United States Patent
Byrne

(10) Patent No.: US 7,074,021 B2
(45) Date of Patent: Jul. 11, 2006

(54) CARTRIDGE TO BE USED WITH A PERISTALTIC PUMP

(75) Inventor: Donny M. Byrne, Montgomery County, TX (US)

(73) Assignee: Byrne Medical, Inc., Conroe, TX (US)

( * ) Notice: Subject to any disclaimer, the term of this patent is extended or adjusted under 35 U.S.C. 154(b) by 249 days.

(21) Appl. No.: 10/434,631

(22) Filed: May 12, 2003

(65) Prior Publication Data

US 2004/0228735 A1 Nov. 18, 2004

(51) Int. Cl.
*F04B 43/08* (2006.01)

(52) U.S. Cl. ..... 417/477.2
(58) Field of Classification Search ..... 417/477.2, 417/477.9, 477.11
See application file for complete search history.

(56) References Cited

U.S. PATENT DOCUMENTS

| | | | | |
|---|---|---|---|---|
| 4,178,138 | A * | 12/1979 | Iles | 417/360 |
| 4,473,342 | A | 9/1984 | Iles | |
| 4,824,339 | A | 4/1989 | Bainbridge et al. | |
| 5,213,483 | A * | 5/1993 | Flaherty et al. | 417/477.2 |
| 5,281,111 | A | 1/1994 | Plambeck et al. | |
| 5,447,417 | A | 9/1995 | Kuhl et al. | |
| 5,814,009 | A | 9/1998 | Wheatman | |
| 6,872,059 | B1 * | 3/2005 | Takahashi et al. | 417/477.3 |

* cited by examiner

*Primary Examiner*—Charles G. Freay
(74) *Attorney, Agent, or Firm*—C. James Bushman; Browning Bushman P.C.

(57) ABSTRACT

A cartridge used with a peristaltic pumping apparatus, the cartridge comprising a housing and a retainer. The housing having a front and back portion along with a peripheral surface, where the front side is selectively engageable with the pumping apparatus and has a first channel formed in the front side. The retainer having a front side and a rear side, the front side adapted to receive a length of flexible tubing, where the rear side is receivable in the first channel.

14 Claims, 3 Drawing Sheets

FIG. 2
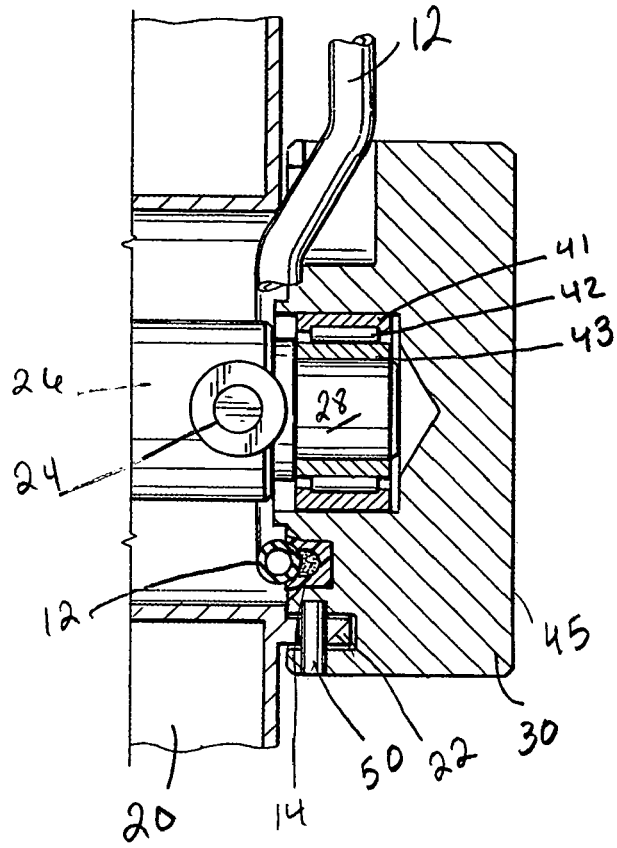
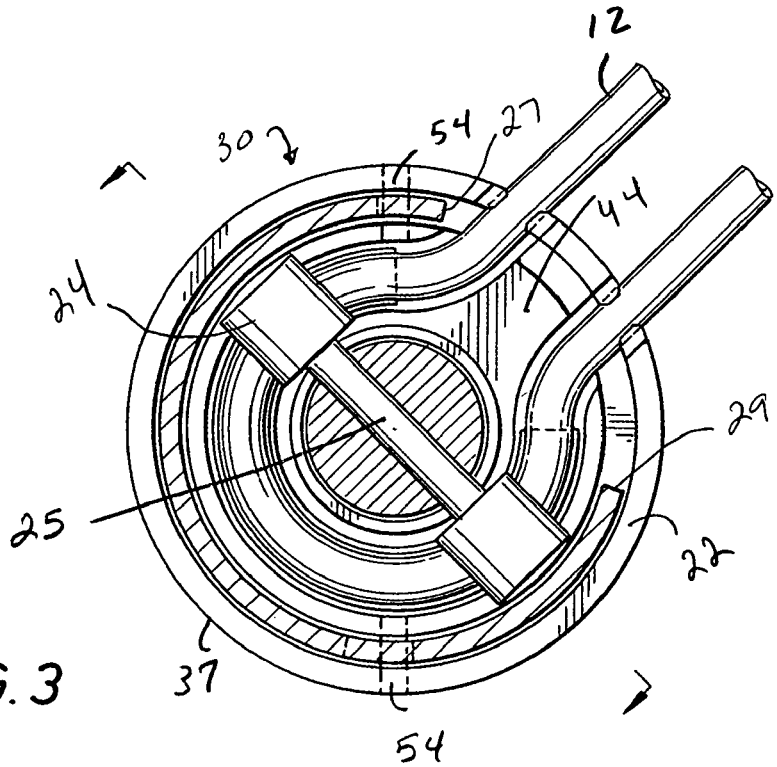
FIG. 3

FIG. 4
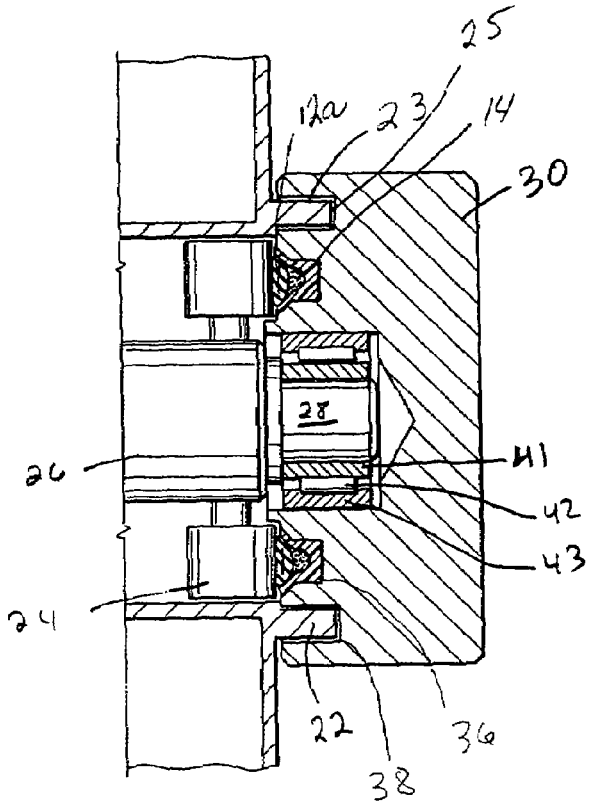
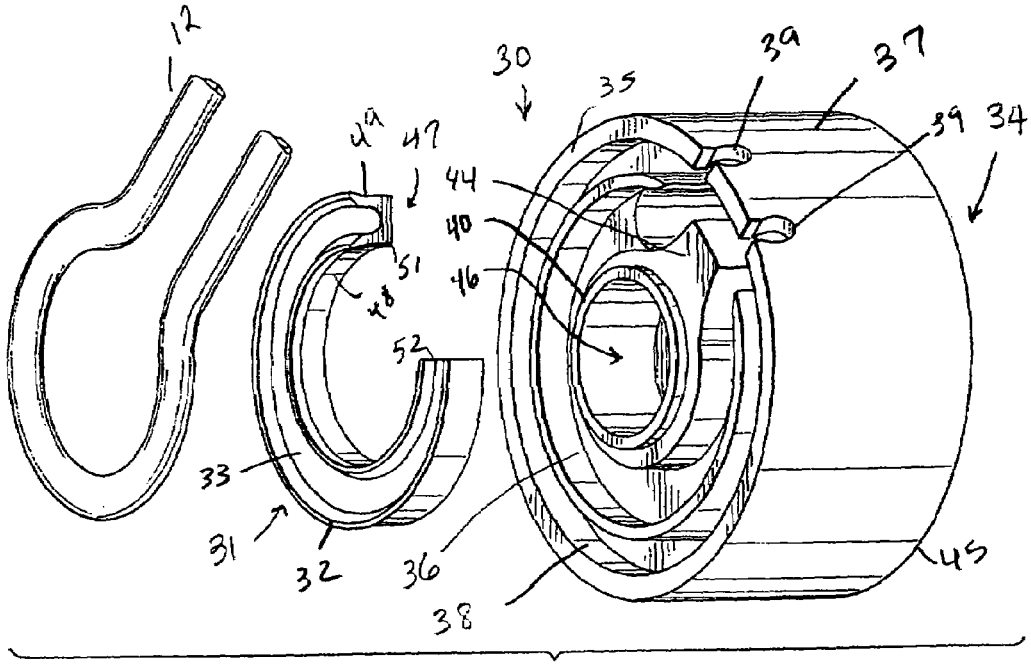
FIG. 5

CARTRIDGE TO BE USED WITH A PERISTALTIC PUMP

BACKGROUND OF THE INVENTION

1. Field of the Invention

The present invention relates generally to the field of peristaltic pumps and related components. More specifically, the present invention relates to an improved cartridge used with peristaltic pumps that allows for seamless, quick, and simple replacement of any associated fluid tubing between successive uses of the peristaltic pump.

2. Description of Related Art

Peristaltic pumping systems with associated tubing and fluid supply reservoirs are commonly employed during medical procedures to pump fluid to different sites within a patient upon whom the medical procedure is being performed. The pumped fluid provides irrigation to support an exploratory procedure for an associated medical scoping device, such as an endoscope and the like. The peristaltic pump is usually provided with a rotating mandrel with one or more rollers spaced around the periphery of the mandrel and attached to the mandrel with a shaft. Fluid, such as sterilized/de-ionized water or a saline solution, is supplied to the peristaltic pump from the fluid storage reservoir via associated tubing. Generally, the tubing is secured to the front surface of a cartridge or adapter that is then releasably attached to the peristaltic pump. The tubing is generally situated onto the cartridge so that its shape matches the path made by the rollers as they rotate around the pump mandrel. When the cartridge is mated with the peristaltic pump, the rollers press up against the tubing, and squeeze the tubing flat between the rollers and the front surface of the cartridge at the spot where the rollers contact the tubing. The squeezing motion imparted onto the tubing by the rollers provides a peristaltic movement of the fluid through the tubing, thus providing positive fluid flow to the site within the patient where the fluid is required to conduct the medical procedure.

During the medical procedure it is possible for a portion of the tubing to physically come into contact with the patient and thus become contaminated by the patient's bodily fluids. Contamination of the fluid can also result from pressure differentials within the tubing causing fluid to be drawn into the tubing from within the patient. Tubing contamination poses a serious health risk to other patients when the fluid delivery system is subsequently used on those other patients. This is especially risky with the proliferation of communicable diseases such as AIDS, hepatitis, tuberculosis, and other such infectious conditions.

While the tubing can be disinfected between uses, the tubing cannot be sterilized or be autoclaved due to its physical limitations. Further, disinfecting the tubing is not always effective since some contaminates can still reside within the tubing even after most disinfecting techniques. Thus the only way to ensure that cross contamination between patients on whom the peristaltic pump is used, is to replace the used tubing with new unused clean tubing after each use. This presents a problem with prior art cartridge systems, since the tubing is permanently mechanically fastened to the rear surface of the cartridge, either integrally molded within or glued on, and thus cannot be readily removed from the cartridge. The tubing is mechanically fastened to the cartridge to maintain the tubing in place against the cartridge when the peristaltic pump operates on the tubing. Because the cartridge itself is expensive, attempts have been made in the past to disinfect the tubing between uses rather than discard the cartridge after its associated tubing has been used—and possibly contaminated with a contagious infection. This is done despite the risk of infecting patients from contaminated tubing. Ultimately however, the cartridge is finally replaced when the tubing can no longer be cleaned or becomes damaged in some fashion. Disposing of the entire cartridge is wasteful since the cartridge itself generally does not become contaminated, and could be used many more times than the tubing. The cartridge is generally thrown away with the tubing since it is difficult to separate the tubing from the cartridge. Discarding the cartridge due to the inability to sterilize the associated tubing results in the unused capacity of the total life of a cartridge unit.

Therefore, there exists a need for a device and method to improve the safety of procedures performed using peristaltic pumping devices, without hindering or slowing the operation of the pump and without adding a significant cost burden. A further need exists to better maximize the lifetime operation of cartridges used with peristaltic pumping devices.

BRIEF SUMMARY OF THE INVENTION

The present invention involves a cartridge for use with a peristaltic pumping apparatus, where the apparatus comprises a housing with a front portion, a back portion, and a peripheral surface. The front portion of the housing is selectively engageable with the pumping apparatus and has a first channel formed therein, which can be arcuate. The invention further includes a tubing anchor adapted to releasably secure a length of tubing in the first channel.

One embodiment of a tubing anchor comprises a retainer having a front side and a rear side, wherein the front side is adapted to engage a length of flexible tubing. The retainer is selectively receivable in the first channel and can also be arcuate, or complimentary in shape to the first channel. The present invention may also include first and second apertures formed within the housing, through the peripheral surface of the housing and which are in open communication with first second portions of the first channel. A yet alternative embodiment of the tubing anchor comprises a series of interlocking hooks and loops adhered to a length of tubing and to the front portion of the housing.

The present invention can further include a bearing mount formed in the front portion where the first channel at least partially surrounds the bearing mount. The present invention also can include a second channel that surrounds the first channel.

The retainer of the present invention can include a groove and be adapted to secure the tubing to its front side, the tubing being partially nested in the groove. A yet alternative embodiment of the present invention includes a length of flexible tubing secured to the front side of the retainer, the length of tubing having a first end projecting through the first aperture and a second end projecting through the second aperture when the retainer is received in said first channel. The length of tubing can be secured to the front side of the retainer by retaining it with glue, cement, adhesive, a series of mating hooks and loops, a press fit of the tubing within the retainer, or some other anchor type system.

A fastener can be provided with the invention to secure the cartridge to the pumping apparatus. One embodiment of a fastener includes at least one pin extending through the peripheral surface and the second channel to secure the cartridge to the pumping apparatus.

BRIEF DESCRIPTION OF THE SEVERAL VIEWS OF THE DRAWINGS

FIG. 2 depicts a partial cross sectional view of one embodiment of the present invention wherein the tubing is shown in the uncompressed state.

FIG. 3 illustrates a partial cross-sectional view taken along the line 3—3 of FIG. 2.

FIG. 4 depicts a view similar to FIG. 2 showing the tubing compressed by the peristaltic pump roller.

FIG. 5 is an exploded perspective view of one embodiment of the present invention.

DETAILED DESCRIPTION OF THE INVENTION

Figure 7:
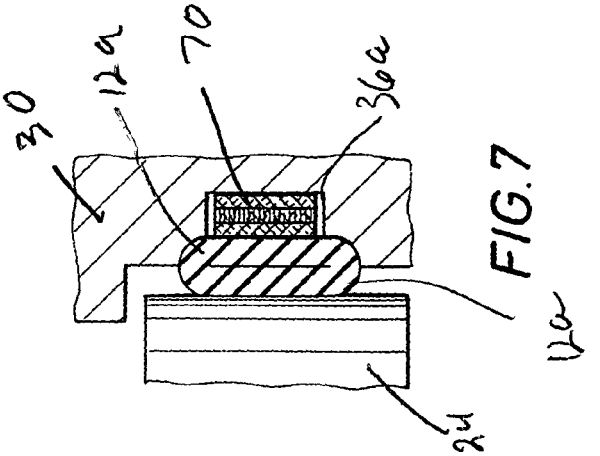
FIG. 7 illustrates a cross sectional view of one embodiment of the present invention wherein tubing is secured to a cartridge with a series of hooks and loops.

With reference to the drawings herein, one embodiment of the cartridge 30 of the present invention is illustrated in an exploded view in FIG. 5. The cartridge 30 is comprised of a housing 34 and a retainer 31, where the housing 34 is provided with a channel 36 to receive the retainer 31. The housing 34 is substantially cylindrical and has a front portion 35, a back portion 45, and a peripheral surface 37. The front portion 35 and back portion 45 are mostly circular and coaxially disposed from one another. Connecting the front portion 35 and the back portion 45 at the end of their respective diameters is the peripheral surface 37 of the housing 34. A cylindrical cavity 46 is formed on the front portion 35 of the housing 30 that is substantially coaxial to the housing 30. Disposed within the cavity 46 is a bearing mount 40 that is also coaxial with the housing 30. The bearing mount 40 is a sleeve like structure adhered within the cavity 46 whose outer end extends out from the front portion 35 of the housing 34.

Also formed on the front portion 35 of the housing 30 is a second channel 38. The first channel 36 is an arcuate "C" shaped groove disposed within the front portion 35 of the housing 34 that circumscribes the bearing mount 40 thus substantially surrounding the bearing mount 40. The respective ends of the first channel 36 terminate on either side of a shoulder 44, where the shoulder 44 is also located on the front portion 35. The shoulder 44 is largely rectangular in cross section with one of its ends being coplanar with the front portion 35. The length of the shoulder 44 runs along the axis of the housing 34 and has a bottom that connects to the inner circumference of the first channel 36. The top of the shoulder 44, which runs parallel to its bottom, is at approximately the same distance from the center of the housing 34 as the outer circumference of the first channel 34.

The second channel 38 is also arcuate and formed on the front portion 35 of the housing 34. The second channel 38 circumscribes the first channel 36. Unlike the first channel 36 that does not travel a full 360° around the axis of the front potion 35, the second channel 38 is fully circular and as such fully circumscribes and surrounds the first channel 36 as well as the bearing mount 40. Apertures 39 are formed through the housing peripheral surface 37 proximate to the front portion 35. The apertures 39 provide a passageway between the second channel 38 and the outer periphery of the housing 34. The apertures 39 should be sufficiently large to allow the tubing 12 to project through the apertures 39 from within the housing 34 without restricting the diameter of the tubing 12. It is preferred that the aperture 39 extend along the axis of the housing 34 to the front portion 35 such that the tubing 12 can be perpendicularly inserted into the aperture 39 from the edge of the front portion 35. Optionally, the tubing 12 could be threaded axially through circular openings (not shown) from within the second channel 38 to the housing peripheral surface 37.

In the embodiment of the invention shown in FIG. 5, the retainer 31 serves to secure 5 a length of tubing 12 within the housing 34 of the cartridge 30. The retainer 31 has a front side 32, a rear side 47, and a groove 33; where the groove 33 is formed on the front side 32 of the retainer 31. The shape of the retainer 31 is largely the same shape as the first channel 36 of the housing 34; that is, the retainer 31 is a "C" shaped arcuate member starting at a first end 51 and terminating at a second end 52. The retainer 31 is formed for insertion into the first channel 36, therefore its outer contour should be substantially the same as the contour of the first channel 36. Further, it is important that the retainer 31 can be readily inserted and removed from the first channel 36, thus the width and length of the retainer 31 should be somewhat less than the corresponding width and length of the first channel 36. It is believed that those skilled in the art can form a retainer of such dimensions and contour without undue experimentation.

Because of its arcuate shape, the sides of the retainer 31 form an inner radius 48 and an outer radius 49 of surface along the length of the retainer 31. The rear side 47, the inner radius 48, and the outer radius 49 of the retainer 31 are largely planer in surface resulting in the retainer 31 having a mostly rectangular cross section when viewed along its radius. The cross section is not entirely rectangular however because of the presence of the groove 33 on the front side 33.

The groove 33, which is formed on the front side 32 of the retainer 31, is preferably centered along the width of the retainer 31 and therefore substantially equidistant between the inner radius 48 and the outer radius 49 of the retainer 31. The tubing 12 is preferably secured to the retainer 31 by a retention element 14, such as with glue, epoxy, cement, or some other securing substance. Alternative manners of retaining the tubing 12 to the retainer 31 include a press fit of the tubing 12 within the groove 33 or a series of mating hook and loop fasteners such as VELCRO® adhered to both the tubing 12 and to the retainer 31.

In operation, a length of the tubing 12 is inserted lengthwise into the groove 33 of the retainer 31. Since the tubing 12 must remain stable, i.e. not "walk," during the peristaltic pumping process, it should be secured within the groove 33. As noted above, the tubing 12 can be glued within the groove 33, press fit, or secured with hook and loop fasteners. Upon securing the tubing 12 to the groove 33 within the retainer 31, the retainer 31 is inserted into the first channel 36 of the housing 34. When the retainer 31 is inserted into the first channel 36, the rear side 47 of the retainer 31 should be positioned into the bottom of the first channel 36 thereby leaving the tubing 12 open and accessible from the front portion 35 of the housing 34.

The overall length of the tubing 12 typically exceeds the length of the groove 33, and therefore will extend well past both ends of the retainer 31. As the retainer 31 is inserted into the first channel 36, the tubing 12 that extends past the retainer 31 ends (51, 52) is placed into the apertures 39 formed through the housing peripheral surface 37. The relative location of the ends (51, 52) with respect to the apertures 39 should not result in the tubing 12 being bent or crimped in order to allow the tubing 12 to pass from the ends (51, 52) of the retainer 31 through the apertures 39. An additional consideration with respect to the formation of the retainer 31 is its physical relationship with the shoulder 44. As can be seen in FIG. 3, when the retainer 31 is inserted into the first channel 36, the first end 51 of the retainer 31 is proximate to one side of the shoulder 44 and the second end 52 is proximate to the other side of the shoulder 44. This prevents the retainer 31 from rotating in the first channel 36 during the pumping operation. Since the tubing 12 exits the groove 33 at each of these ends (51, 52), the ends (51, 52) should be spaced away from the sides of the shoulder 44 to allow the tubing 12 to exit each of the ends (51, 52) without crimping or binding as it passes up to the apertures 39. Since the tubing 12 communicates between the ends (51, 52) and each of the apertures 39, and the ends (51, 52) are within the first channel 36, it should now be apparent to those skilled in the art that the apertures 39 are in open communication with the first channel 36.

Inserting the retainer 31 with its associated tubing 12 into the first channel 36 of the housing 34 forms one embodiment of the cartridge 30 of the present invention. Once the cartridge 30 is formed it can then be attached to the peristaltic pump 20 so fluid can be pumped through the tubing 12 in a manner above described. One embodiment of the present invention shown in FIGS. 2 and 4 illustrates the cartridge 30 mated with the peristaltic pump 20. When the cartridge 30 is attached to the peristaltic pump 20, the nose portion 28 of the mandrel 26 protrudes within the cavity 46 of the housing 34 and is encompassed by the bearing mount 40. Disposed on the outer circumference of the nose portion 28 is a bearing assembly comprising, an inner race 41, an outer race 43, and bearings 42. The bearings 42 are disposed between the inner race 41 and the outer race 43. While the bearings 42 are shown as roller bearings, other shapes and type of bearings rolling friction reducers can be used, such as ball bearings, needle bearings, or a lubricant film in lieu of bearings. The presence of the bearing mount 40 stabilizes the mandrel 26 by maintaining the nose portion 28 within a close axis of rotation when the peristaltic pump 20 is in operation. Further, as is well known, the bearing assembly minimizes rotational frictional forces produced by rotating the nose portion 28 within the housing 34, due to the inclusion of its bearings 42 and inner and outer races (41, 43).

It should now be apparent to those skilled in the art that one of the advantages of the present invention is the ability to remove a length of tubing 12 from the cartridge 30 and return the same length of tubing 12 back into the cartridge 30 or replace the length of tubing 12 with another length of tubing 12. Furthermore, when that length of tubing 12 is returned or replaced into the cartridge 30, it is secured within the cartridge 30 and ready to be used with a peristaltic pump 20. Thus the present invention provides the ability to releasably secure a length of tubing 12 within the cartridge 30 since tubing 12 can be easily released from the cartridge 30, it can also be returned/replaced within the cartridge 30 and secured therein. This is a distinct advantage over prior art cartridges whose associated tubing is permanently affixed to the cartridge by gluing such that the tubing is incapable of being releasably secured to the cartridge.

Figure 6:
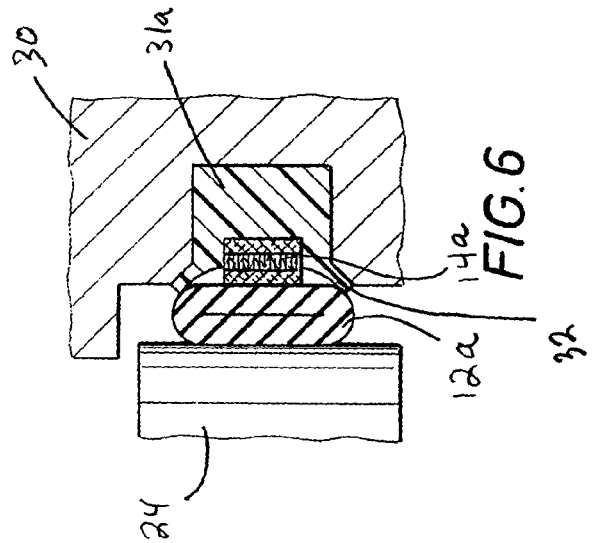
FIG. 6 depicts a cross sectional view of one embodiment of the present invention wherein tubing is secured to a retainer with a series of hooks and loops.
Figure 1:
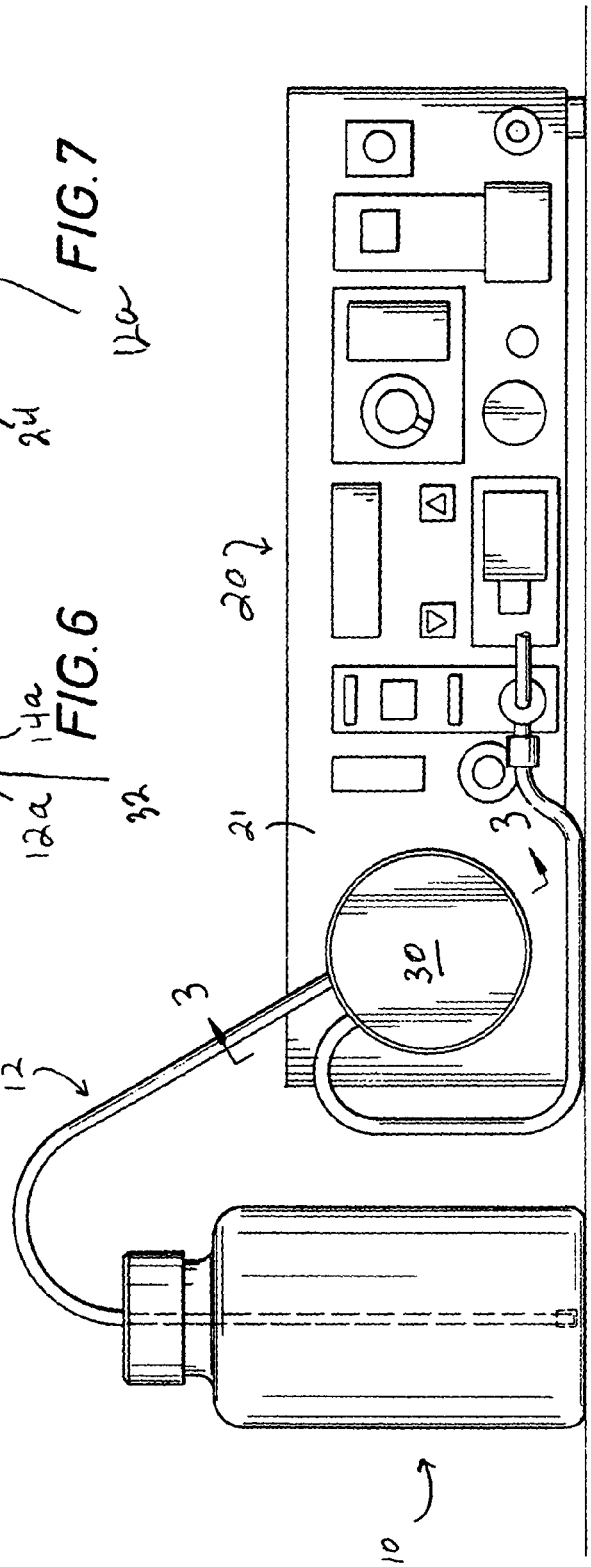
FIG. 1 is a frontal view of a peristaltic pumping apparatus with a fluid storage bottle.

Referring now to FIG. 6 one alternative embodiment of the cartridge 30 of the present invention is demonstrated. There a cross sectional view of how the tubing 12*a* can be secured to the retainer 31 with a series of hooks and loops is shown. In FIG. 6 a roller 24 is rolling past and squeezing a section of a length of tubing 12*a* thereby flattening it to impart a peristaltic pumping operation within the tubing 12*a*. As shown in this embodiment, the retention element 14*a* comprises a series of hooks and loops, one section of which is adhered to the tubing 12*a*, and the other corresponding hook and loop section is adhered to the front side 32 of the retainer 31*a*.

Another alternative embodiment of the tubing anchor of the present invention is illustrated in FIG. 7. There the tubing is anchored to the cartridge 30 with a series of mating hooks and loops 70. One section of hooks and loops 70 are adhered to the tubing 12*a* while the corresponding section of hooks and loops 70 is adhered within the first channel 36*a* of the cartridge 30. As is important with the other embodiments of the tubing anchor, the series of mating hooks and loops 70 should anchor the tubing 12*a* on the front portion 35 of the cartridge 30 to ensure that the tubing 12*a* is properly acted on by the rollers 24. Further, the series of mating hooks and loops 70 must apply a sufficient anchoring force onto the tubing 12*a* to ensure that the tubing 12*a* does not walk when contacted by the rollers 24.

Alternatively, the front side 32 of the retainer 31 can be substantially planar and therefore not include a groove 33 formed therein. Accordingly, in this alternative embodiment, the cross section of the retainer 31 when viewed along its radius would be largely rectangular with respect to all four sides of the retainer 31. However, it is important that the dimensions of the retainer 31 be adjusted to ensure that when the rollers 24 engage and flatten the tubing 12*a*, the width of the retainer 31 must be able to accommodate the flattened width of the tubing 12*a*. However the groove 33 permits easy, stable positioning of the tubing while the tubing is being secured to the retainer 31.

Also illustrated in FIGS. 2 and 4 is one manner of attaching the cartridge 30 to the peristaltic pump 20. As shown in the Figures an arcuate lip 22 is formed on the front 21 of the peristaltic pump 20 that circumscribes the mandrel 26 and rollers 24 of the peristaltic pump 20. The radial cross section of the lip 22 is mostly rectangular where its sides extend out and away from the peristaltic pump 20 and terminate at the top 25 of the lip 22. Similar to the retainer 31, the lip 22 has a first end 27 and extends in an arcuate shape along its length and terminates at its second end 29. The depth of the sides 23, width of the top 25, and contour of the lip 22 are formed such that the lip 22 can readily fit within the second channel 38 formed on the housing 34. It is preferred that the length of the lip 22 not traverse a full 360° around the mandrel 26, but instead be "C" shaped similar to the shape of the retainer 31. The "C" shape of the lip 22 provides a free space at the opening of the "C" for travel of the tubing 12 from the retainer 31 to the apertures 39.

To secure the cartridge 30 to the peristaltic pump 20, pins 50 are inserted radially through holes 54 formed in the housing 34 between the second channel 38 and the housing peripheral surface 37. Corresponding slots (not shown) are formed within the lip that have an "L" or "J" type configuration such that the slots can receive the pins 50 in a direction axial to the lip 22 up to the base of the lip 22, then the slots extend in a direction along the circumference of the lip 22. Accordingly, the cartridge 30 can be secured to the peristaltic pump 20 by aligning the pins 50 with the axial portion of the slots, inserting the pins 50 into the axial opening of the slots, and radially rotating the cartridge 30 so the pins 50 are urged into the circumferential portion of the slot. Since the slot has an angular shape, the pins 50 are prevented from moving axially away from the peristaltic pump 20 until the cartridge 30 is rotated back into the position such that the pins 50 are within the axial portion of the slots.

The peristaltic pumping system 1 can be activated as soon as the cartridge 30 is secured to the peristaltic pump 20. As seen in FIGS. 2 and 4, securing the cartridge 30 to the peristaltic pump 20 disposes the tubing 12 adjacent the rollers 24. Also, the contour of the groove 33 should match the path the rollers 24 travel while the rollers 24 are rotating around the mandrel 26. Thus, while the mandrel 26 rotates the rollers 24, the rollers 24 remain in contact with the tubing 12 except when the rollers 24 pass between the ends (51, 52) of the retainer 31. It is between the ends (51, 52) of the retainer 31 where the tubing 12 passes from the retainer 31 up to the apertures 39 and is thus out of the arcuate path of the rollers 24.

As can also be seen from FIG. 4, at the point where the rollers 24 contact the tubing 12 the tubing 12*a* is flattened by the rollers 24 as the rollers 24 pass along the tubing 12*a*, the fluid within the tubing 12 is pushed through the tubing 12 in front of the travel path of the rollers 24. Due to the force imparted onto the tubing 12 by the rollers 24 as it flattens the tubing 12*a*, it is important that the adhesive 14 be sufficiently strong to prevent the tubing 12 from being moved out of the groove 33 of the retainer 31, and thus out of the path that the rollers 24 travel. If the tubing 12 becomes dislodged from the retainer 31 and is out of the roller 24 path, the peristaltic pump 20 will no longer function since fluid cannot be urged within the tubing 12 by the rollers 24.

To further prevent cross contamination of medical patients because of contaminated tubing 12 used with a peristaltic pumping system 1, the present invention allows for the readily and easy replacement of the tubing 12 between successive uses. For example, upon completion of a medical procedure involving a peristaltic pumping system 1 having the present invention, the cartridge 30 can be quickly and easily removed from the peristaltic pumping system 1 and the used tubing 12 is disposed of and replaced with new unused tubing 12 by removing the retainer 31 having the tubing 12 and replacing it with a retainer 31 having new unused tubing 12. Thus the costly and time-consuming procedure of attempting to disinfect contaminated tubing can be eliminated. Furthermore, a full assurance of uncontaminated tubing with each successive use of the peristaltic pumping apparatus can be guaranteed. Moreover, since the cartridge 30 of the present invention can be used with multiple replacements of retainers 31 with associated tubing 12, without the need to replace the cartridge 30, the waste associated with unnecessarily discarding peristaltic pump cartridges can be minimized. The cartridge 30 of the present invention need only be replaced when it has become worn or damaged, thus maximizing the usable life of the cartridge 30.

The present invention described herein, therefore, is well adapted to carry out the object and attain the ends and advantages mentioned, as well as others inherent therein. While a presently preferred embodiment of the invention has been given for purposes of disclosure, numerous changes exist in the details of the manner and procedures for accomplishing the desired results. For example, the retainer 31 can be replaced with other ways of securing the tubing 12 within the cartridge 30, such as adhering corresponding hook and loop fasteners to both the tubing 12 and within the first channel 36 of the housing 34 thereby eliminating the need for the retainer 31. This and other similar modifications will readily suggest themselves to those skilled in the art, and are intended to be encompassed within the spirit of the present invention disclosed herein and the scope of the appended claims.

What is claimed is:

1. A cartridge for use with a peristaltic pumping apparatus comprising:

a housing having a front portion, a back portion, and a peripheral surface, said front portion having a first channel formed therein; and a tubing anchor adapted to releasably secure a length of tubing in said first channel, said tubing anchor comprising a retainer having a front side and a rear side, said front side being adapted to engage a length of tubing, said retainer being adapted to fixedly secure said tubing to said front side of said retainer, said tubing being affixed to said retainer by adhesive.

2. A cartridge for use with a peristaltic pumping apparatus comprising:

a housing having a front portion, a back portion, and a peripheral surface, said front portion being selectively engagable with said pumping apparatus and having a first channel formed therein; and a tubing anchor adapted to releasably secure a length of tubing in said first channel, said first channel being arcuate in shape;

a second channel being formed in said front portion of said housing, said second channel being in surrounding relationship to said first channel and a pin extending through said peripheral surface into said second channel to cooperative form a fastener selectively securing said cartridge to said pump.

3. A cartridge for use with a peristaltic pumping apparatus comprising:

a housing having a front portion, a back portion, and a peripheral surface, said front portion being selectively engagable with said pumping apparatus and having a first channel formed therein; and a tubing anchor adapted to releasably secure a length of tubing in said first channel, said tubing anchor comprising a series of mating interlocking hooks and loops.

4. A cartridge for use with a peristaltic pumping apparatus comprising:

a housing having a front portion, a back portion and a peripheral surface, said front portion being selectively engagable with said pumping apparatus and having a first channel formed therein; and a tubing anchor adapted to releasably secure a length of tubing in said first channel, said tubing anchor comprising a retainer having a front side and a rear side, said front side being adapted to engage a length of tubing, said tubing being secured to said retainer by a retention element selected from the group consisting of glue, cement, adhesive, a press fit arrangement, and a series of mating interlocking hooks and loops.

5. A method of using a cartridge with a peristaltic pumping apparatus, where the cartridge comprises a housing having a front portion, a back portion, and a peripheral surface, said front portion having a first channel formed therein, said cartridge further comprising a tubing anchor adapted to releasably secure a length of tubing in said first channel, said tubing anchor comprising a retainer having a front side and a rear side, said front side being adapted to engage a length of tubing comprising:

anchoring a length of tubing within said first channel to form a cartridge; and engaging said tubing in said retainer with a retention element selected from the group consisting of glue, cement, adhesive, a press-fit arrangement, and a series of mating interlocking hooks and loops.

6. A method of using a cartridge with a peristaltic pumping apparatus wherein the cartridge comprises a housing having a front portion, a back portion, and a peripheral surface, said front portion having a first channel formed therein, said cartridge further comprising a tubing anchor adapted to releasably secure a length of tubing in said first channel, said tubing anchor comprising a series of mating, interlocking hooks and loops, comprising:

anchoring a length of tubing to said tubing anchor with said series of interlocking hooks and loops.

7. The housing of any one of claims 1–4 wherein there is a first aperture in said peripheral surface in open communication with a first portion of said first channel and a second aperture in said peripheral surface in open communication with a second portion of said channel.

8. The cartridge of any one of claims 1–4 wherein said housing includes a bearing mount formed in said front portion.

9. The cartridge of any one of claims 1–4 wherein said first channel is in at least partially surrounding relationship to said bearing mount.

10. The cartridge of any one of claims 1 or 4 wherein said retainer is arcuate.

11. The cartridge of any one of claims 1 or 4 wherein said front side of said retainer has a groove.

12. The cartridge of any one of claims 1 or 4 further including a length of flexible tubing secured to said front side of said retainer, said length of tubing having a first end projecting through said first aperture and a second end projecting through said second aperture when said retainer is received in said first channel.

13. The cartridge of any one of claims 1 or 4 wherein said retainer includes a groove in said front side and said tubing is partially nested in said groove.

14. The method of any one of claims 1 or 4, wherein said tubing anchor comprises a retainer having a front side and a rear side, said front side being adapted to engage a length of tubing further comprising: engaging said tubing to said retainer with a retention element selected from the group consisting of, glue, cement, adhesive, a press fit arrangement, and a series of mating interlocking hooks and loops.

* * * * *